United States Patent [19]

Demizu

[11] Patent Number: 4,566,410

[45] Date of Patent: Jan. 28, 1986

[54] DIESEL ENGINE GLOW PLUG CONTROLLING DEVICE

[75] Inventor: Akira Demizu, Hyogo, Japan

[73] Assignee: Mitsubishi Denki Kabushiki Kaisha, Tokyo, Japan

[21] Appl. No.: 633,016

[22] Filed: Jul. 20, 1984

[30] Foreign Application Priority Data

Jul. 21, 1983 [JP] Japan ..... 58-133943

[51] Int. Cl.[4] ..... F02P 19/02

[52] U.S. Cl. ..... 123/179 BG; 123/179 H

[58] Field of Search ..... 123/179 BG, 179 B, 179 H, 123/145 A; 364/431.1; 219/497

[56] References Cited

U.S. PATENT DOCUMENTS

| | | | |
|---|---|---|---|
| 4,285,307 | 8/1981 | Steinke | 123/179 BG |
| 4,331,109 | 5/1982 | Arnault | 123/145 A |
| 4,399,781 | 8/1983 | Tsukasaki | 123/179 BG |
| 4,491,100 | 1/1985 | Yasuhara | 123/179 BG |

FOREIGN PATENT DOCUMENTS

| | | | |
|---|---|---|---|
| 57-46067 | 3/1982 | Japan | 123/145 A |

*Primary Examiner*—Andrew M. Dolinar

*Attorney, Agent, or Firm*—Bernard, Rothwell & Brown

[57] ABSTRACT

A diesel engine glow plug controlling device provided with a computer capable of processing digital values obtained through the analog-to-digital conversion of a temperature-equivalent voltage corresponding to the temperature of the glow plugs and a water temperature detection signal corresponding to the temperature of the cooling water of the diesel engine. The computer processes the digital values to decide the duration of closing of a glow relay provided in a power supply circuit for supplying a current to the glow plugs. When the temperature of the glow plugs is higher than a predetermined temperature, the computer decides a current supply period in which a detection current is supplied from detection current supply means to the glow plugs.

10 Claims, 8 Drawing Figures

COLD STARTING MODE ($T_1$°C≧)

HOT STARTING MODE ($T_1$°C≦)
PRIOR ART

COLD STARTING MODE (T1 °C≧)

HOT STARTING MODE (T1 °C≦)

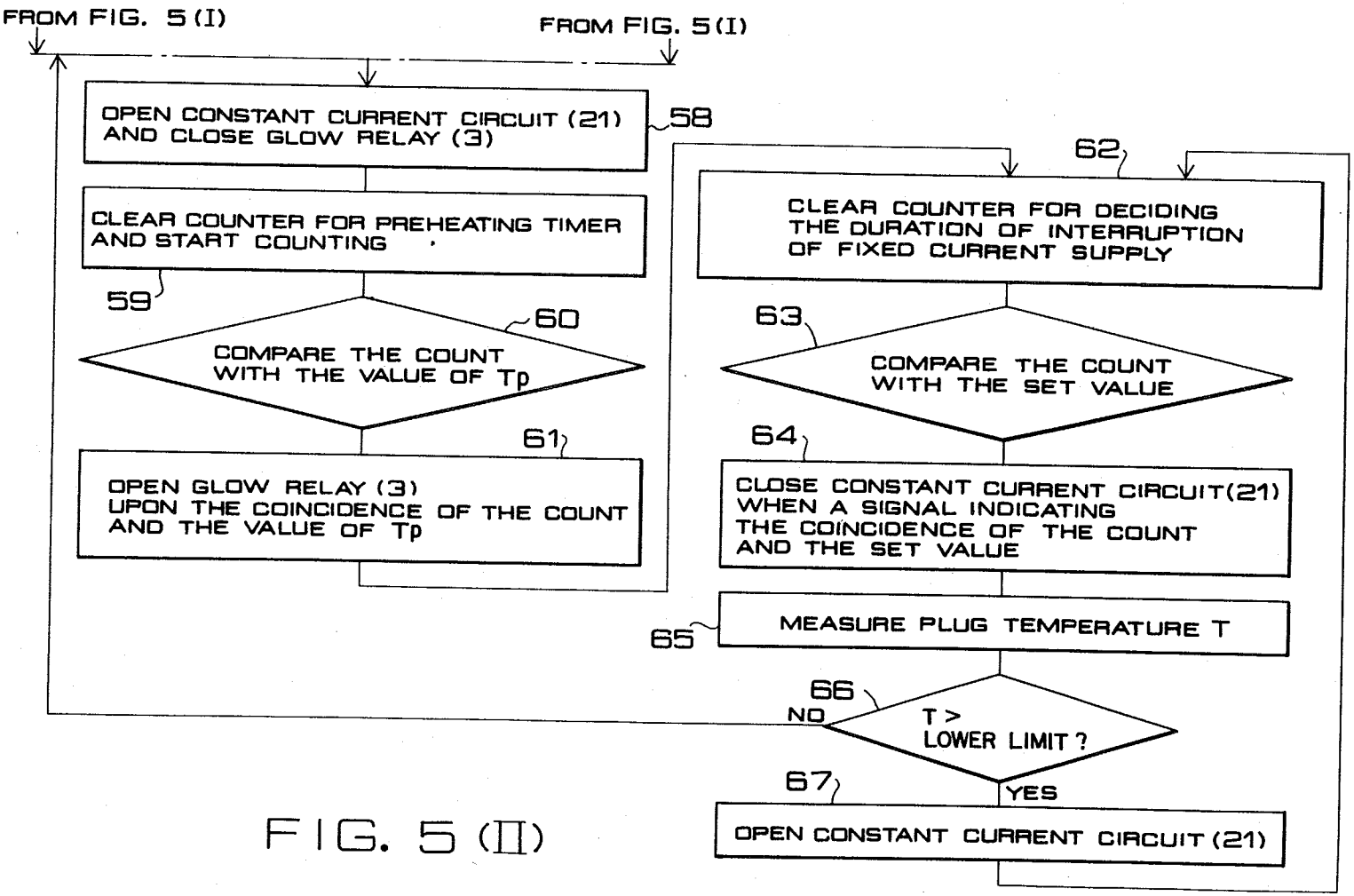
FIG. 5 (II)

DIESEL ENGINE GLOW PLUG CONTROLLING DEVICE

BACKGROUND OF THE INVENTION

1. Field of the Invention

The present invention relates to a glow plug controlling device for controlling the temperature of the glow plug of a diesel engine.

2. Description of the Prior Art

An exemplary conventional glow plug controlling device is illustrated in FIG. 1. Referring to FIG. 1, there are shown a key switch 1 and a control unit 2 comprising a constant current circuit 21, an inverting amplifier 22, a sensing timer 23, a temperature level detecting circuit 24, a chopping timer 25, a control circuit 26, a glow relay output circuit 27 and a water temperature detecting circuit 28.

Also shown in FIG. 1 are a glow relay 3 which is controlled by the glow relay output circuit 27, glow plugs 4 of a positive resistance temperature characteristic each provided for a cylinder of the engine and connected in series to the glow relay 3, a battery 5, a water temperature sensor 6 of a negative resistance temperature characteristic provided in the water pipe of the engine to detect the temperature of the engine cooling water.

The action of the glow plug controlling device of FIG. 1 thus constituted will be described hereunder in connection with FIG. 2 showing time charts. In a cold engine starting mode in which preheating is necessary, the key switch 1 is thrown to a preheating starting position G as indicated at (A) in FIG. 2(*a*) (water temperature: $T_1$° C. or below), then the control unit 2 is connected to a power source. At this time, the constant current circuit 21 functions as indicated at (B) in FIG. 2 to supply a fixed current to the glow plugs 4. A voltage drop corresponding to the resistance of the glow plugs 4 at the present temperature occurs in the glow plugs 4.

The inverting amplifier 22 inverts and amplifies the voltage drop and gives the inverted and amplified voltage drop signal to the sensing timer 23 and the temperature level detecting circuit 24. The sensing timer 23 determines a current supply time for the glow relay 3 on the basis of the temperature-equivalent voltage signal and gives the signal of the current supply time to the control circuit 26.

At the same time, the water temperature detecting circuit 28 detects that by means of the resistance that varies according to the temperature of the engine cooling water, it is lower than a temperature corresponding to a predetermined set temperature $T_1$° C., for example, 15° C., and gives a signal for supplying a current to the glow plugs 4 to the control circuit 26.

On the other hand, the temperature level detecting circuit 24 decides whether the temperature equivalent voltage given thereto by the inverting amplifier 22 is greater than or less than a reference voltage corresponding to a lower limit temperature. If the temperature equivalent voltage is less than the reference voltage, the temperature level detecting circuit 24 gives an operation start signal to the chopping timer 25 and, if greater than the reference voltage, gives an operation stop signal to the chopping timer 25.

At the moment of connection of the power source to the control unit 2, the control circuit 26 inhibits the chopping timer 25 to give an output signal. Accordingly, when the power source is connected to the control unit 2, the glow relay 3 is thrown to ON position as indicated at (C) in FIG. 2, through the glow relay output circuit 27 for a current supply time determined by the sensing timer 23. When the glow relay 3 is actuated, a current is supplied directly from the battery 5 to the glow plugs 4, so that the temperature of the glow plugs 4 rises gradually as indicated at (D) in FIG. 2.

When a current is supplied to the glow plugs 4, the voltage drop at the glow plugs 4 is equivalent to the maximum voltage (battery voltage). Consequently, the output current of the constant current circuit 21 is interrupted as indicated as (B) in FIG. 2, and the output of the inverting amplifier 22 is reduced to the minimum value.

After the time decided by the sensing timer 23 for keeping the glow relay 3 at ON position has passed, the control circuit 26 puts the glow relay 3 to OFF position through the glow relay output circuit 27 to interrupt the current supply to the glow plugs 4.

Since the sensing timer 23 decides the duration of current supply to the glow relay 3 after the key switch 1 has been thrown to the preheating starting position G, in inverse proportion to the temperature (temperature equivalent resistance) of the glow plugs 4, the glow plugs 4 are heated approximately to an objective temperature regardless of the initial temperature of the glow plugs 4.

Upon the interruption of current supply to the glow plugs 4, as indicated at (B) in FIG. 2, the constant current circuit 21 is actuated again to give a signal of voltage drop under the fixed current, corresponding to the lowering temperature of the glow plugs 4, to the inverting amplifier 22. The output of the inverting amplifier 22 increases as the temperature of the glow plugs 4 lowers. Upon the arrival of the output of the inverting amplifier 22 at the predetermined reference voltage of the temperature level detecting circuit 24 corresponding to the lower limit temperature, the temperature level detecting circuit 24 gives an operation starting signal to the chopping timer 25. This signal causes the chopping timer 25 to operate for a predetermined period of time.

In this state, the control circuit 26 keeps the glow relay 3 through the glow relay output circuit 27 at ON position for a time decided by the chopping timer 25 to supply a current to the glow plugs 4. The same operation is repeated thereafter to control the temperature of the glow plugs 4 at a temperature slightly higher than the lower limit temperature.

Then, the key switch 1 is thrown to ST position to supply a current to the starter motor in order to start the engine. After the engine has been started, the key switch 1 returns to ON position and the control operation is completed.

The operation of the glow plug controlling device in a hot starting mode will be described hereinafter. As shown in FIG. 2(*b*), in which the water temperature is higher than $T_1$° C., since the water temperature is higher than the set temperature, the water temperature detecting circuit 28 generates a current supply stopping signal to stop current supply to the glow plugs 4. Upon the reception of the current supply stopping signal, the control circuit 26 controls the glow relay output circuit 27 so as to stop current supply to the glow relay 3.

Generally, when the water temperature is $T_1$° C. or higher, the fuel is ignited readily without preheating and, as indicated at (E) in FIG. 2(*b*), the operating time of the starter motor is shorter than that in the cold starting mode, The temperature rise of the glow plugs 4 indicated at (D) in FIG. 2(*b*) is not due to electrical heating, but is due to the heat generated by the combustion of the fuel in the cylinders.

Since the conventional glow plug controlling device is constituted as described hereinbefore, the power consumption of the constant current circuit is large in detecting the temperature of the glow plugs, because the constant current circuit continuously supplies the glow plugs with a constant current and hence the constant current circuit needs to be constituted of elements of large allowable power capacities, needs to be provided with a heat radiating plate to prevent the thermal breakdown of the component elements resulting from a high heat generation due to electric power consumption, and is subject to temperature rise due to heat generation, which is liable to cause the variation of the fixed current.

SUMMARY OF THE INVENTION

Accordingly, it is an object of the present invention to provide a compact and highly precision glow plug controlling device for a diesel engine, eliminated of the disadvantages of the conventional glow plug controlling device. In a glow plug controlling device according to the present invention, the constant current circuit is pulse-driven to reduce fixed current supply time so that power consumption, heat generation and the size of the device are reduced, the heat radiating plate is eliminated and the temperaturedependence of fixed current is improved.

A glow plug controlling device of the present invention comprises a glow relay connected directly to the power supply circuit of a diesel engine for supplying electric power to the glow plugs, detecting current supplying means to generate a temperature-equivalent voltage by supplying a current to the glow plugs while the glow relay is opened, and a water temperature sensor to detect the temperature of the engine cooling water. The analog values of the temperature-equivalent voltage and the output signal of the water temperature sensor are converted into digital values and the digital values are given to a computer. The computer decides whether or not the engine needs to be preheated, on the basis of the output signal of the water temperature sensor and when necessary, the computer calculates a current supply time which is necessary to heat the glow plugs to a predetermined temperature. Then, the computer generates a current supply time signal, to open the detection current supply means and a signal to close the glow relay. After the current supply time has passed, the computer generates signals to close and open the detection current supply means at fixed intervals until the temperature of the glow plugs drops below a predetermined temperature.

BRIEF DESCRIPTION OF THE DRAWINGS

FIGS. 5(I) and 5(II) are a flow chart for explaining the functions of the device of FIG. 3.

DESCRIPTION OF THE PREFERRED EMBODIMENTS

Figure 3:
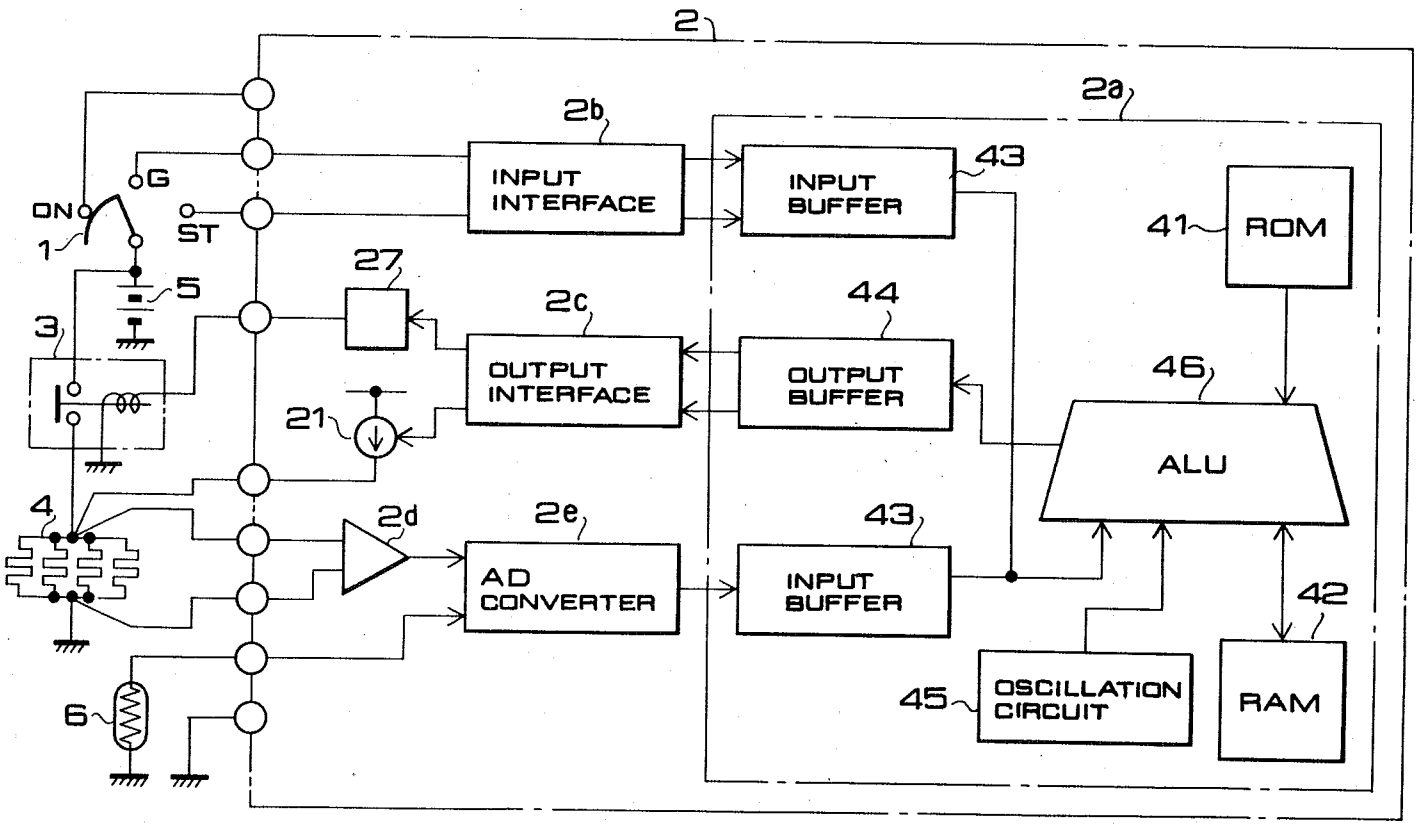
FIG. 3 is a block diagram showing the circuit constitution of a glow plug controlling device according to the present invention.

A preferred embodiment of a glow plug controlling device according to the present invention will be described hereinafter in connection with the accompanying drawings. FIG. 3 is a block diagram showing the circuit constitution of the preferred embodiment of the present invention. In FIG. 3, the same parts as those of FIG. 1 are designated by the same reference characters and the explanation thereof is omitted.

Figure 1:
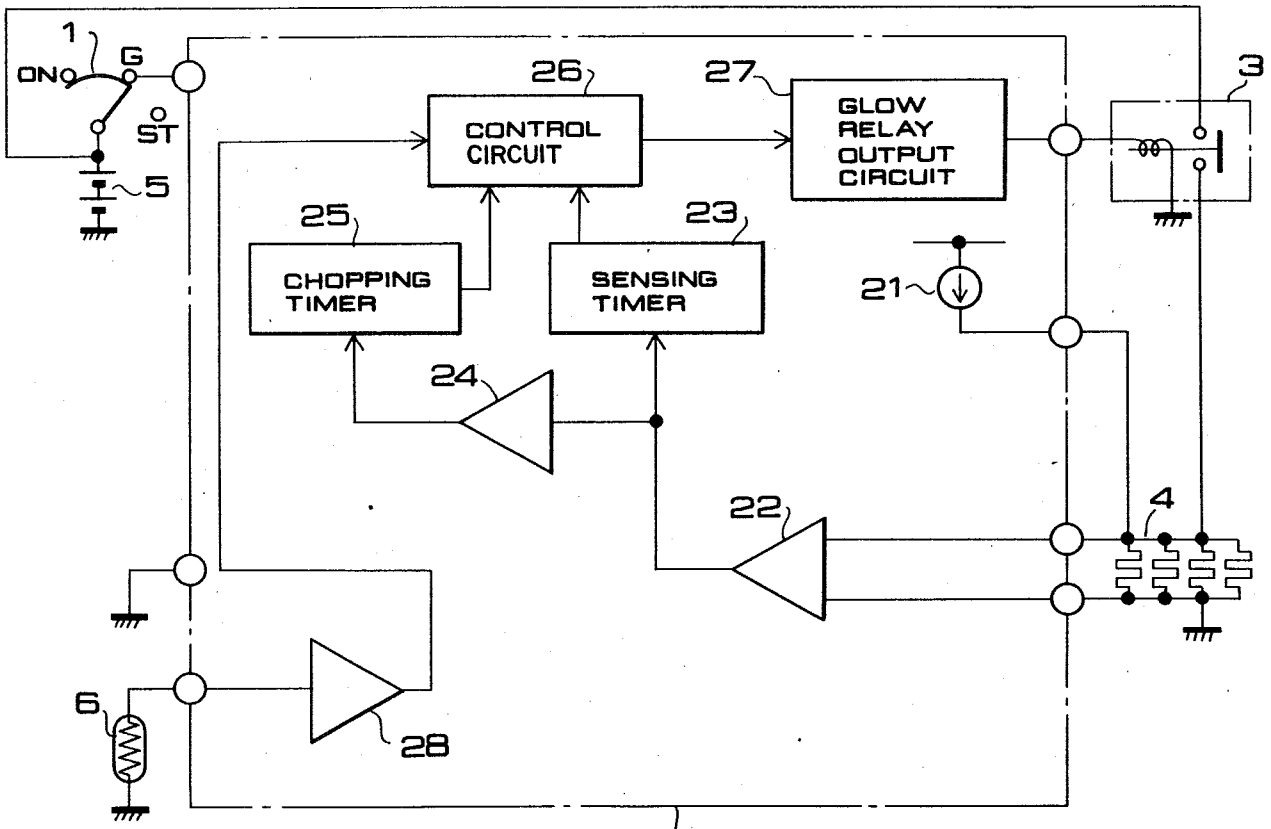
FIG. 1 (PRIOR ART)
FIG. 1 is a block diagram showing the circuit constitution of a conventional glow plug controlling device.
Figures 2A, 2B:
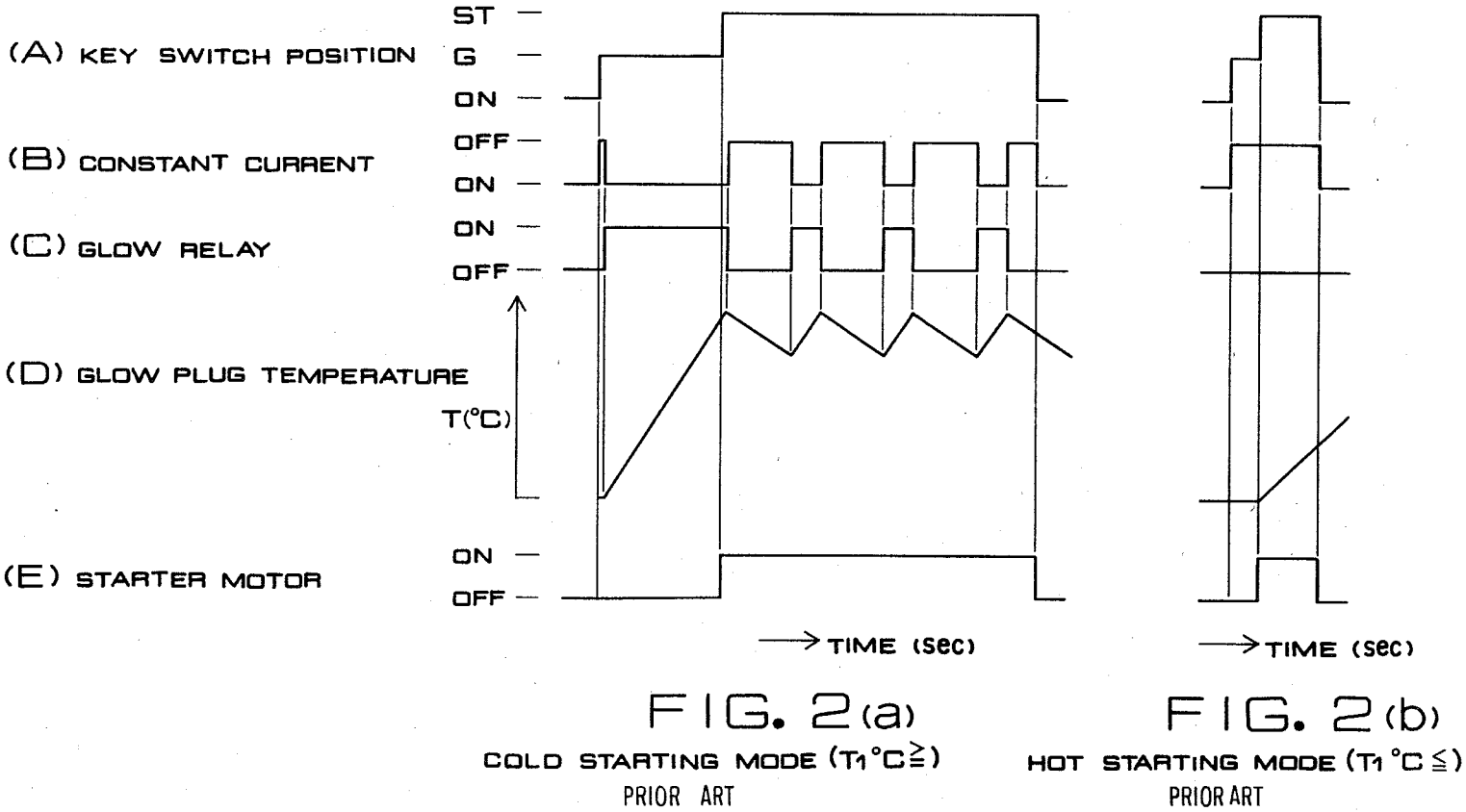
PRIOR ART FIG. 2(b)
FIGS. 2*a*) and 2(*b*) show time charts explaining the mode of glow plug temperature controlling operation of the glow plug controlling device of FIG. 1.

As shown in FIG. 3, the inverting amplifier 22, the sensing timer 23, the temperature level detecting circuit 24, the chopping timer 25, the control circuit 26 and the water temperature detecting circuit 28 of the conventional glow plug controlling device of FIG. 1 are replaced by a one-chip computer 2*a* provided in the control unit 2. The one-chip computer 2*a* comprises a read only mexory (abbreviated to "ROM" hereinafter) 41 for storing a fixed control procedure, a read-write memory (abbreviated to "RAM" hereinafter) 42 for storing information temporarily, an input buffer 43 for receiving signals, an output buffer 44 for sending out output signals, an oscillation circuit 45 of a fixed frequency for determining the operation period of the computer, and an arithmetic and logic unit (abbreviated to "ALU" hereinafter) 46 for executing the procedure decided by the ROM 41. The control unit 2 further comprises an input interface 2*b* for giving input signals to the one-chip computer 2*a*, an output interface 2*c* for giving the output signals of the one-chip computer 2*a* to the glow relay output circuit 27 and the constant current circuit 21, an amplifier 2*d* for amplifying a voltage drop caused by a resistance corresponding to the temperature of glow plugs 4, to a predetermined level, and an AD converter 2*e* for converting analog signals given by the amplifier 2*d* and the water temperature sensor 6 into digital signals and for applying the digital signals to the one-chip computer 2*a*. Other constitution of the present glow plug controlling device is the same as that of the glow plug controlling device of FIG. 1.

The operating mode of the glow plug controlling device according to the present invention thus constituted will be described hereinafter in connection with the time charts shown in FIG. 4 and the flow chart shown in FIG. 5. First, in a cold engine starting mode, as indicated at (A) in FIG. 4(*a*) (for an engine starting condition where the water temperature is $T_1$° C. or below), a key switch 1 is thrown to a preheating starting position (G). Then, the one-chip computer 2*a* receives through the input interface 2*b* and the input buffer 43 a terminal G ON information and starts control operation according to the control procedure stored in the ROM 41.

First, in Step 51, the one-chip computer 2*a* detects on the basis of the output signal of the water temperature sensor 6 encoded by the AD converter into a digital signal that the water temperature is lower than $T_1$° C. In this temperature condition where the water temperature is lower than $T_1$° C., preheating by means of glow plugs 4 is necessary, therefore, the one-chip computer 2*a* closes the constant current circuit 21 through the output buffer 44 and the output interface 2*c* to supply a predetermined current to the glow plugs 4 (Step 52). Then a voltage drop corresponding to a resistance which is equivalent to the temperature of the glow plugs 4 occurs.

The amplifier 2*d* amplifies the voltage drop and applies the amplified voltage drop to the AD converter 2*e*. The AD converter converts the value of the voltage drop given thereto into a digital signal and sends the same to the one-chip computer 2*a* (Step 54).

The one-chip computer 2*a* receives the plug-temperature equivalent digital signal through the input buffer 43 and stores the same in a plug temperature register allocated in the RAM 42 (Step 55).

Then, the one-chip computer 2*a* calculates a current supply time Tp required to supply a current to the glow relay 3 to heat the glow plugs 4 to a predetermined temperature, on the basis of the stored plug-temperature equivalent digital value and stores the calculated result in the RAM 42 (Step 56).

Figures 4A, 4B:
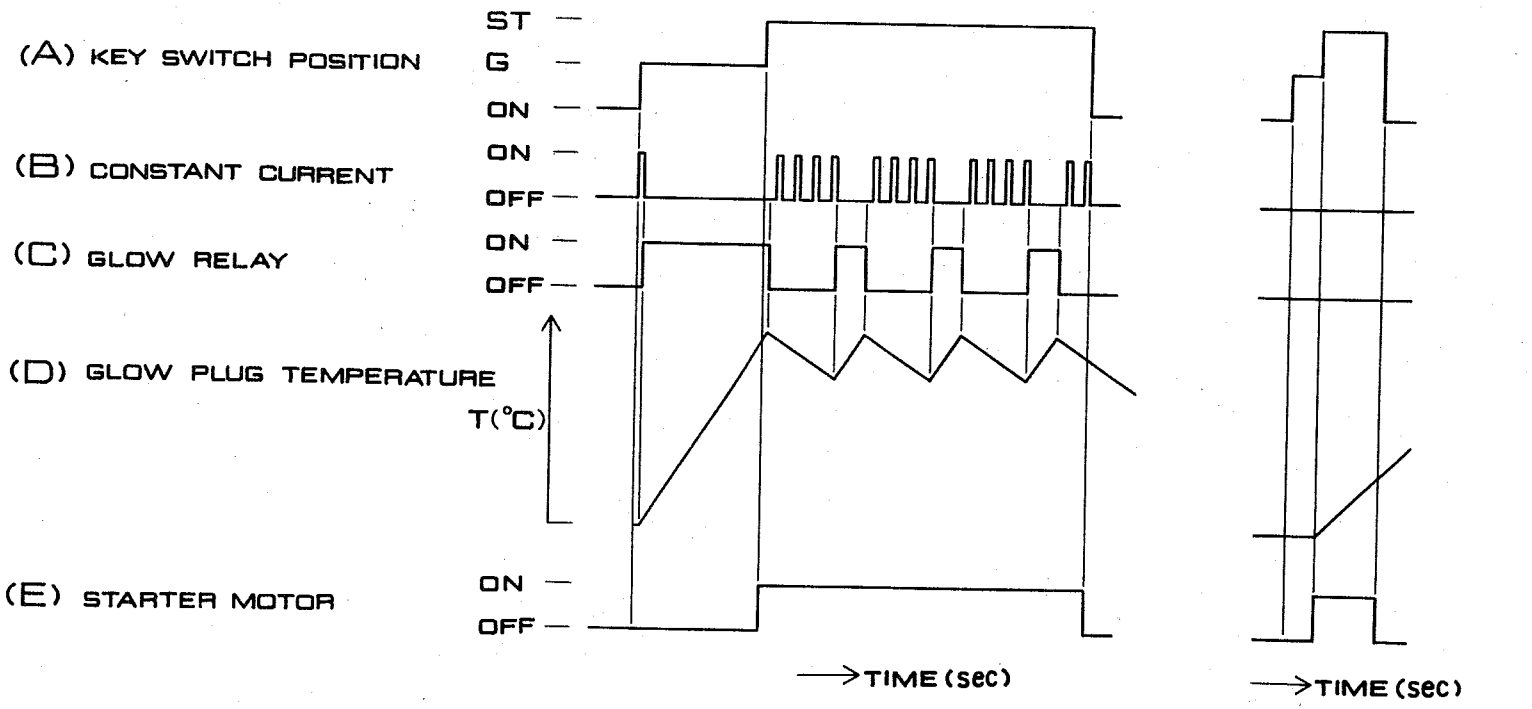
FIGS. 4(*a*) and 4(*b*) show time charts explaining the mode of glow plug temperature controlling operation of the glow plug controlling device of FIG. 3.
Figure 5:
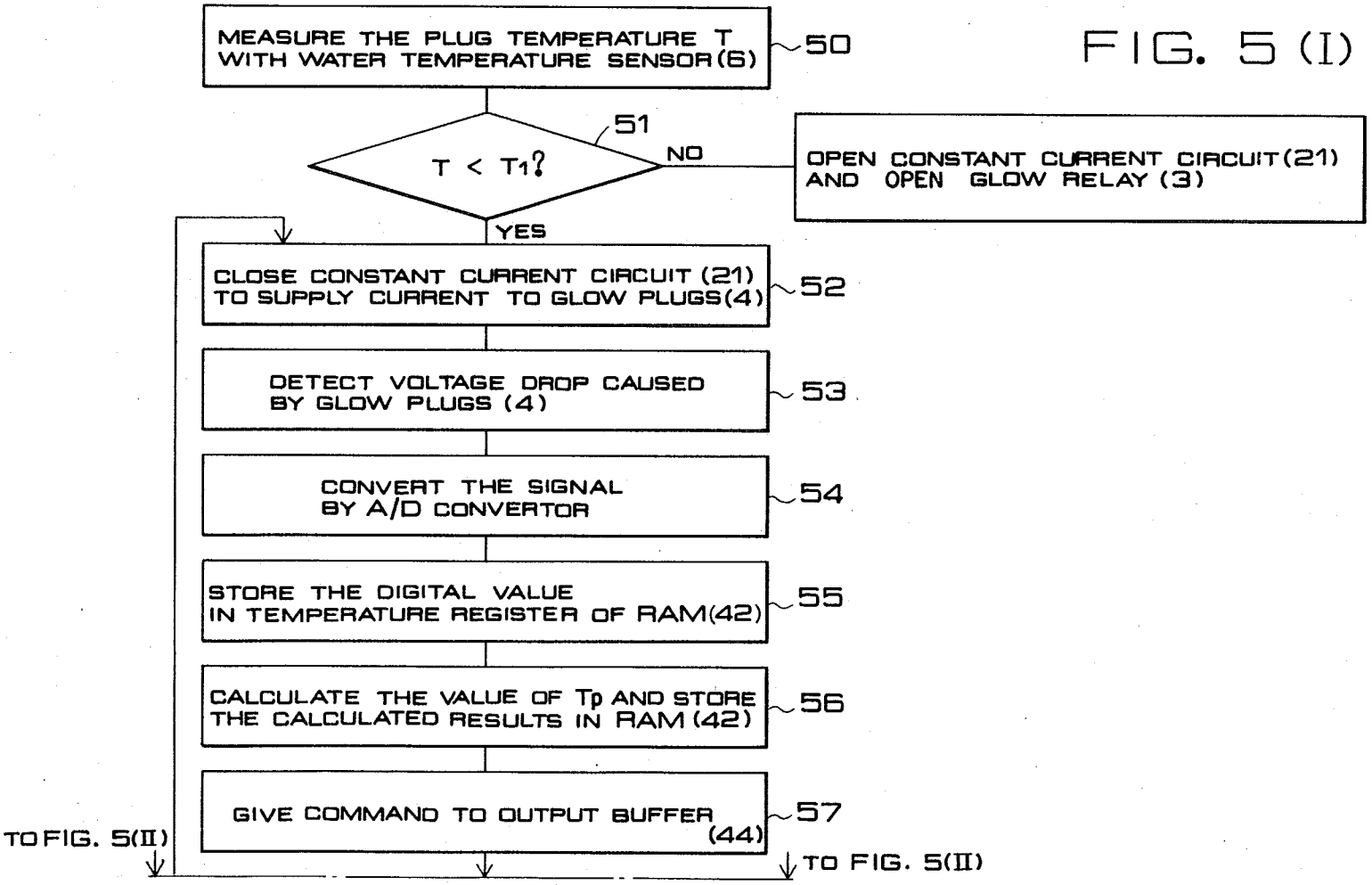

Then, a command is given to the output buffer 44 (Step 57) to open the constant current circuit 21 and to close the glow relay 3, as indicated at (B) and (C) in FIG. 4(*a*) (Step 58). When the glow relay 3 is closed, a current is supplied directly from the battery 5 to the glow plugs 4, and thereby the temperature of the glow plugs 4 rises gradually as indicated at (D) in FIG. 4(*a*).

On the other hand, a preheating timing counter provided in the RAM 42 is cleared to zero and starts counting by counting up at each calculation cycle of the one-chip computer according to the output signal of the oscillation circuit 45. The time through which the glow relay 3 is kept closed is decided through the comparison between the count of the preheating timer counter provided in the RAM 42 and the previously decided current supply time Tp by the ALU 46. Upon the coincidence of the count with the current supply time Tp in Step 60, the one-chip computer 2*a* turns off the glow relay 2 (Step 61). Since the current supply time Tp through which the glow relay is kept closed is decided in inverse proportion to the temperature of the glow plugs 4, the glow plugs 4 are heated up approximately to an objective temperature regardless of the initial temperature of the glow plugs 4.

When the glow relay 3 is opened, current supply to the glow plugs 4 is interrupted and the temperature of the glow plugs 4 starts dropping as indicated at (C) and (D) in FIG. 4(*a*). Then, the one-chip computer 2*a* clears a constant current OFF timing counter provided in the RAM 42 to zero, and thereby the counter starts counting and counts up at each operating cycle of the one-chip computer (Step 62). Upon the detection of the coincidence of the count of the counter with the value stored in the ROM 41 through comparison in Step 63, the constant current circuit is closed again (Step 64) as indicated at (B) in FIG. 4(*a*) and the temperature of the plug is measured by the agency of the amplifier 2*d* and the AD converter 2*e*, as indicated at (D) in FIG. 4(*a*) (Step 65). The temperature of the plug is compared with a set value stored in the ROM 41 in Step 66 and if the temperature of the plug is higher than the set value stored in the ROM 41, the constant current circuit 21 is opened (Step 67) and the constant current OFF timing counter is started again. After the count has reached the predetermined value, the constant current circuit 21 is closed again and the temperature of the plug is measured. Thus the constant current circuit 21 is closed and opened at fixed intervals until the temperature of the plug drops to the set value stored in the ROM 41.

Upon the arrival of the temperature of the plug at the set value Steps 52 through 56 are repeated and the current supply time Tp is calculated again and the glow relay 3 is kept closed for the time Tp to supply a current to the glow plugs 4. Thereafter, the same control operations as described hereinbefore are repeated to control the temperature of the glow plug 4 at a temperature slightly higher than the objective lower limit temperature.

Then, the key switch 1 is thrown to ST position to supply a current to the starter motor in order to start the engine. After the engine has been started, the key switch 1 returns to ON position to complete the control operation.

The operation of the glow plug controlling device in a hot starting mode will be described hereinafter.

Referring to FIG. 4(*b*), where the water temperature is $T_1$° C. or above, when the key switch 1 is thrown to the preheating starting position (G) as indicated at (A), the one-chip computer 2*a* detects on the basis of the output signal of the water temperature sensor 6 given thereto through the AD converter 2*e* that the water temperature is higher than $T_1$° C. Since preheating is unnecessary when the water temperature is about $T_1$° C., the one-chip computer 2*a* opens the constant current circuit 21 and the glow relay 3 as indicated at (B) and (C) in FIG. 4(*b*). Consequently, no current is supplied to the glow plugs 4, and hence the temperature of the glow plugs is raised only by the heat generated by the combustion of fuel in the cylinders as indicated at (D) in FIG. 4(*b*).

In the above-mentioned embodiments, the control starting timing is when the key switch 1 is thrown to the preheating position (G), however, the control starting timing may be when the key switch is thrown to the position (ON). Furthermore, the software timing counter of count-up system employed in the above-mentioned embodiment may be substituted by a method of detecting zero by counting down from a predetermined number or a method employing a free running counter which reads the count at a necessary time and the count thereafter and decides a time by calculating the differential between the counts. Furthermore, the same result as the present embodiment is obtained by providing a timer of hardware type in the one-chip computer or by providing an external timer as a time counter for the device.

Thus, the employment of the one-chip computer as the control unit of a glow plug controlling device enables the periodic ON-OFF driving of the constant current circuit which supplies a fixed current to the glow plugs to detect the temperature of the glow plugs and the remarkable reduction of heat generation through the reduction of the average power consumption. Accordingly, the heat radiating plate of the current control element of the constant current circuit, which is essential to the conventional glow plug controlling device, is eliminated, and thereby the size of the element is reduced to enable the formation of a compact device. Furthermore, improvement in the temperature dependence of the fixed current value contributes to the improvement of the accuracy of plug temperature measurement.

What is claimed is:

1. A glow plug controlling device for a diesel engine having a plurality of cylinders comprising:

glow plugs of a fixed resistance temperature characteristic attached to the cylinders;

a glow relay connected in series to a power supply circuit for supplying a fixed current to the glow plugs;

detection current supply means to supply a detection current to the glow plugs in order to detect the temperature of the glow plugs while the glow relay is opened;

a water temperature sensor of a fixed resistance temperature characteristic for detecting the temperature of the cooling water of the engine;

a key switch for generating a glow plug controlling operation starting signal;

analog-to-digital conversion means for converting the analog values both of a temperature detect1on signal corresponding to a voltage drop caused by the glow plugs under the detection current and of a detection signal given by the water temperature sensor into digital values; and a computer adapted to decide whether or not the engine needs to be preheated on the basis of the detection signal given by the water temperature sensor when the glow plug controlling operation starting signal is given by the key switch, to calculate a current supply time necessary to heat the glow plugs to a predetermined temperature when the preheating is necessary, to generate an OFF-signal to interrupt the function of the detection current supply means and an ON-signal to close the glow relay during said current supply time, and to generate periodically ON- and OFF-signals for starting and interrupting the operation of the detection current supply means after the passage of said current supply time until the temperature of the glow plugs drops to a temperature below a predetermined temperature.

2. A glow plug controlling device according to claim 1, wherein the current supply to the glow relay is controlled according to the output signal of the analog-to-digital conversion means stored in the computer.

3. A glow plug controlling device according to claim 1, wherein said glow relay is controlled so as to interrupt current supply to the glow plugs when the temperature of the engine cooling water is higher than the predetermined temperature.

4. A glow plug controlling device according to claim 1, wherein said computer comprises a read-only memory to store a fixed control procedure; a read-write memory to store information temporarily; an input buffer for receiving input signals; an output buffer for giving output signals; an oscillation circuit of a fixed frequency for deciding the operating cycle of the computer; and an arithmetic and logical unit which executes the control procedure read out from the read-only memory.

5. A glow plug controlling device according to claim 1, wherein the glow plug controlling operation starting signal corresponds to a timing when the key switch is thrown to the PREHEAT-position.

6. A glow plug controlling device according to claim 1, wherein the glow plug controlling operation starting signal corresponds to a timing when the key switch is thrown to the ON-position.

7. A glow plug controlling device according to claim 1, wherein said computer includes a timer for deciding the duration of interruption of said fixed current supply and said timer is a software of count-up system.

8. A glow plug controlling device according to claim 1, wherein said computer includes a timer for deciding the duration of interruption of said fixed current supply and said timer is of a zero detection type in which a predetermined value is counted down.

9. A glow plug controlling device according to claim 1, wherein said computer includes a timer for deciding the duration of interruption of said fixed current supply and said timer is a free running counter.

10. A glow plug controlling device according to claim 1, wherein said computer includes a timer for deciding the duration of interruption of said fixed current supply and said timer is of a hardware type included in the computer.

* * * * *